United States Patent [19]

Chabala et al.

[11] Patent Number: 4,596,906

[45] Date of Patent: Jun. 24, 1986

[54] ARRANGEMENT FOR PROVIDING INDEPENDENT ROTARY AND LINEAR DRIVE OUTPUTS FOR HIGH-VOLTAGE SWITCHES

[75] Inventors: Leonard V. Chabala, Maywood; Walter J. Hall, Evanston; Robert H. Harner, Park Ridge; Edward J. Rogers, Chicago; Norman J. Stranczek, Niles; Thomas J. Tobin, Northbrook, all of Ill.

[73] Assignee: S&C Electric Company, Chicago, Ill.

[21] Appl. No.: 721,616

[22] Filed: Apr. 10, 1985

[51] Int. Cl.[4] ..... H01H 31/00

[52] U.S. Cl. ..... 200/48 R

[58] Field of Search ..... 200/48 R, 48 A, 48 P

[56] References Cited

U.S. PATENT DOCUMENTS

| | | | |
|---|---|---|---|
| 3,333,071 | 7/1967 | Oppel et al. | 200/48 R |
| 3,432,780 | 3/1969 | Evans et al. | 335/68 |
| 3,566,055 | 2/1971 | Weston | 200/48 R |

*Primary Examiner*—Stephen Marcus
*Assistant Examiner*—Renee S. Kidorf
*Attorney, Agent, or Firm*—James V. Lapacek

[57] ABSTRACT

An arrangement including an insulative support column provides independent rotary and linear drive outputs for the operation of electrical switches, circuit interrupters and/or disconnects or the like. A first, linear drive linkage provides translating motion at a first output in response to linear translating motion at a first input. The linear drive arrangement is provided by an elongated, insulative operating member that is disposed within an elongated bore of the insulative support column, with the operating member extending through the top and bottom ends of the column. A second, rotary drive output is provided by rotation of the support column. The column fixedly carries a lower base member which is rotatably supported within a base housing. The operating member extends through and exits the base member and cooperates with a bearing carried by the base member. The lower end of the operating member is coupled to the linear drive linkage input. The support column is rotated by means of a suitable drive linkage attached at the lower end of the column. A tubular shaft is fixedly carried at the top of the column, the operating member extending therein. Rotation of the tubular shaft is coupled through suitable linkage to drive a disconnect or the like. For interrupters that are mounted generally perpendicular to the longitudinal axis of the support column, the cylindrical wall of the tubular shaft is cut away to provide for the output connection of the operating member to a transfer linkage without interference from the rotation of the tubular shaft.

30 Claims, 6 Drawing Figures

58
74
56
80
72
78
76
64
82
60
62
57
3
3
70
68
54
100
96
55
98
51
12
10
53
42
14
18
30
16
28
40
38
36
32
24
34
22
23
44
20
26
46
48
50
86

16
14
42
40
30
38
32
28
120

124

146
42
24
142
138
22
44
144
126
136
122
148
26
140
150
23
130
132
104
106
108
110
46
134
48
48
50

ARRANGEMENT FOR PROVIDING INDEPENDENT ROTARY AND LINEAR DRIVE OUTPUTS FOR HIGH-VOLTAGE SWITCHES

CROSS-REFERENCE TO THE RELATED APPLICATION

This application is directed to an improved drive arrangement including a rotatable support column which in a preferred construction makes use of the insulating material disclosed and claimed in commonly-assigned, co-pending Application Ser. No. 721,615 filed in the names of L. V. Chabala et al on Apr. 10, 1985.

BACKGROUND OF THE INVENTION

1. Field of the Invention

The present invention relates generally to the field of drive arrangements for electrical switches and interrupters and more particularly to a drive arrangement that provides independent rotary and linear outputs and includes a rotatable support column having an operating member longitudinally disposed therethrough to provide the linear output; rotation of the column providing the rotary output.

2. Description of the Related Art

Various support columns, operating columns, and operating members are known for use with electrical switches, disconnects, interrupters, and the like. These arrangements are normally subjected to line-to-ground voltage. For example, U.S. Pat. No. 3,508,178 discloses a rotatable insulator that is utilized in the switch operator linkage. A sequencing mechanism at the live parts drives both a disconnect blade and an interrupting unit. Another smaller diameter rotatable insulator is utilized in an auxiliary trip arrangement for rapid tripping. Other arrangements utilize a separate reciprocating insulator.

Another similar arrangement disclosed in U.S. Pat. No. 4,110,579 obtains rapid interrupter tripping by a rapid initial rotation of the main rotatable insulator during its operative movement, continued rotation opening a disconnect switch.

Additionally, other drive linkage arrangements include insulator columns sealed with pressurized gas or oil that carry translational operating members driven in various manners, commonly by pivotal linkage members that enter the sealed insulator column through an "O" ring seal or the like. Other arrangements of this type can be categorized as using a crank arrangement with a rotating shaft seal. Another arrangement utilizes a pneumatically-driven operating rod in a circuit-breaker. A typical example of this arrangement is available from AEG under the designation SF7 Auto Pneumatic.

While these arrangements are generally suitable for their intended purpose, these arrangements are not applicable or desirable for all applications and it is advantageous to provide improved drive arrangements that efficiently combine independent rotary and translational operating drives with the translational drive being capable of rapid operation without any external parts exposed to the environment. For example, it is necessary to provide rapid movement for operation of an interrupting unit. Since the drive for this rapid movement is subjected to line-to-ground voltage, the prior arrangements that utilize separate insulators for this movement are limited in speed by the mass of the insulator. Further, as to the prior arrangements that combine the drives, these combined drives are either limited in speed by the mass of the insulator or require a relatively complicated mechanism at line potential for each phase.

SUMMARY OF THE INVENTION

Accordingly, it is a principal object of the present invention to provide independent rotary and linear drive outputs in an arrangement for operating interrupters, disconnects, or the like including a rotatable insulative support column having an elongated operating member disposed therethrough.

It is another object of the present invention to provide a rotary output drive and a translational output drive that are independently operable with the rotary drive being provided by rotation of a generally hollow member affixed atop an insulator column and the translational drive being provided by an elongated operating member disposed within the hollow member, the hollow member being cut away to allow coupling of the operating member to a linkage arrangement outside the hollow member.

Briefly, these and other objects and advantages of the present invention are provided by an arrangement including an insulative support column having independent rotary and linear drive outputs for the operation of electrical switches, circuit interrupters and/or disconnects or the like. A first, linear drive linkage provides translational motion at a first output in response to linear translating motion at a first input. The linear drive arrangement is provided by an elongated, insulative operating member that is disposed within an elongated bore of the insulative support column, with the operating member extending through the top and bottom ends of the column. A second, rotary drive output is provided by rotation of the support column. The column fixedly carries a lower base member which is rotatably supported within a base housing. The operating member extends through and exits the base member and cooperates with a bearing carried by the base member. The lower end of the operating member is coupled to the linear drive linkage input. The support column is rotated by means of a suitable drive linkage attached to the lower base member. A tubular shaft is fixedly carried at the top of the column, the operating member extending therein. Rotation of the tubular shaft is coupled through suitable linkage to drive a disconnect or the like. For operation with an interrupter arranged in parallel with the column, the operating member extends beyond the top edge of the tubular shaft to control the interrupter. For interrupters that are mounted generally perpendicular to the longitudinal axis of the support column, the cylindrical wall of the tubular shaft is cut away to provide for the output connection of the operating member to a transfer linkage without interference from the rotation of the tubular shaft. The tubular shaft is cut away in accordance with the required rotation for the operative cycle of the tubular shaft independent of the translational position of the operating member. The transfer linkage is connected to the top of the operating member to translate motion of the operating member along the longitudinal axis of the column to translational motion in a direction perpendicular to the support column. Accordingly, the arrangement provides independent operating outputs from a single rotatable support column; for example, a linear reciprocative drive output via reciprocation of the operating member through the column and a rotary drive output by rotation of the column. For desirable insulating properties, the support column is filled with an insulating material. A sealing arrangement in the base member is provided for the operating member to prevent loss of the insulating material during translation of the operating member or rotation of the support column. A housing for the tubular shaft and the transfer linkage output, if utilized, is attached at one end to the interrupter and is rotatably supported by the tubular shaft. The operative stroke of the operating member is limited in the upward direction by the interaction of a widened portion of the operating member and a shock-absorbing assembly having a central aperture smaller than the cross section of the widened portion of the operating member.

BRIEF DESCRIPTION OF THE DRAWING

The invention both as to its organization and method of operation, together with further objects and advantages thereof, will best be understood by reference to the specification taken in conjunction with the accompanying drawing in which.

DETAILED DESCRIPTION

Figure 1:
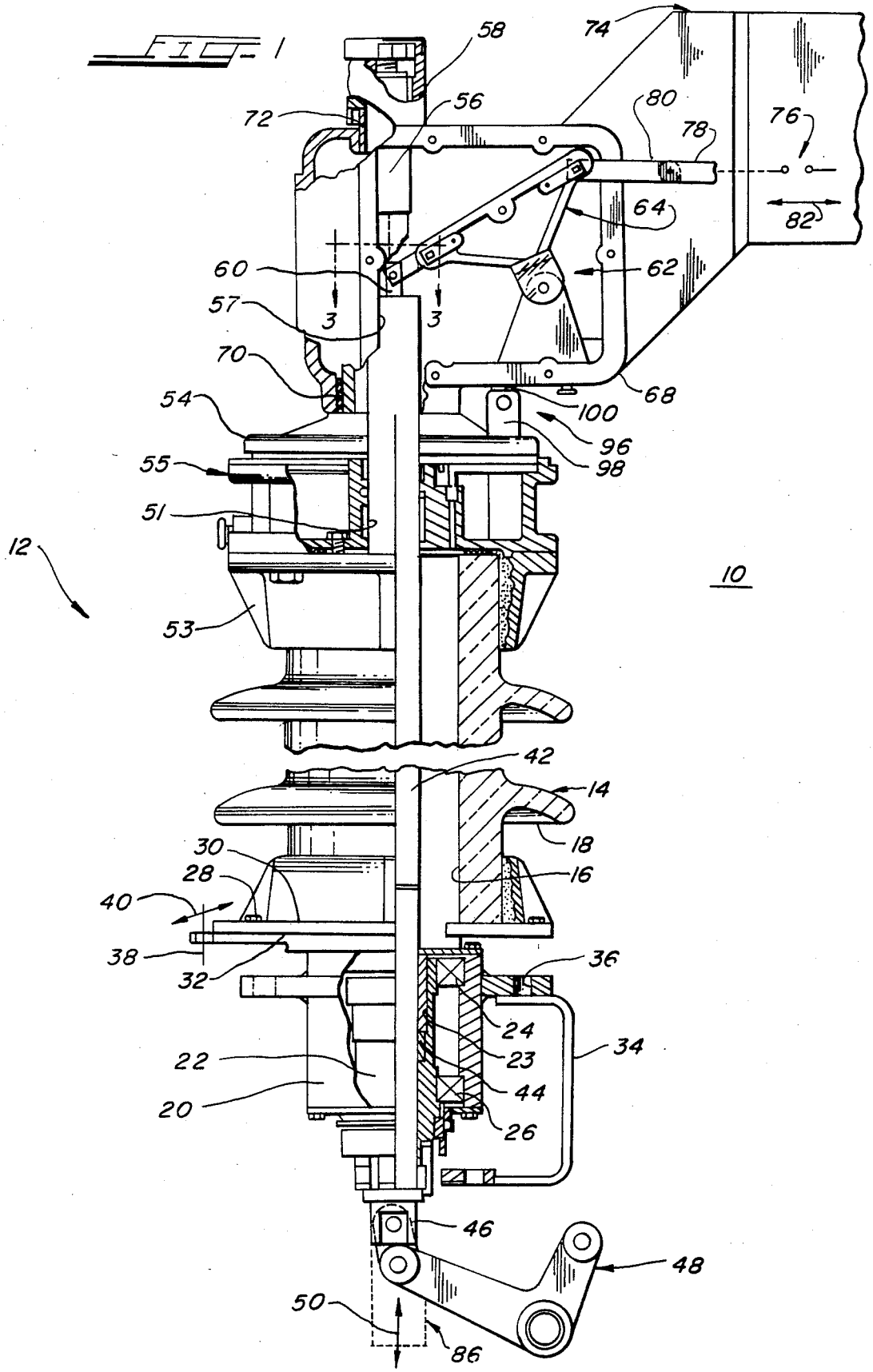
FIG. 1 is an elevational view, partly in section and with parts cut away, of the drive arrangement of the present invention.

Referring now to FIG. 1, the arrangement 10 of the present invention to provide independent rotary and linear drive outputs for operating switches, interrupters and disconnects or the like includes a rotatable support column 12 which may also be referred to as an insulative operating column. The rotatable support column 12 includes an elongated insulator 14 having a longitudinal bore 16 extending therethrough and a plurality of external insulator shells or sheds 18.

The rotatable support column 12 is mounted for rotation with respect to a base housing 20 by bearings 24,26 cooperating with a base member 22 of the rotatable support column 12. The base member 22 is fixedly fastened to the insulator 14 by means of suitable fasteners referred to generally at 28. The fasteners 28 sealingly interconnect a mounting flange 30 of the insulator 14 and the base member 22. In the specific illustration, the housing 20 is carried by a base beam 34 and rigidly attached thereto by fasteners 36. The support column 14 is rotated by a drive linkage referred to at 38 via interconnection to a drive arm 32 of the base member 22. Accordingly, operation of the drive linkage 38 represents the rotary drive input of the arrangement 10 as illustrated by the bidirectional arrows at 40.

An elongated operating member 42 is disposed through the longitudinally extending bore 16 and cooperates with a bearing 44 of the base member 22 so as to be capable of translational and rotational movement with respect to the rotatable support column 12. The lower end of the elongated operating member 42 fixedly carries an end fitting 46. As illustrated in FIG. 1, the end fitting 46 is pivotally connected to a bell crank 48. Accordingly, clockwise and counterclockwise pivoting of the bell crank 48 causes linear movement of the operating member 42 with respect to the rotatable support column 12 and in the directions illustrated at 50; the movement of the bell crank 48 representing a linear drive input.

The operating member 42 at the upper end thereof, as shown in FIG. 1, passes through the insulator 14 and into a tubular shaft 52. The tubular shaft 52 is fixedly attached to the upper end of the insulator 14 by means of a flange 54 of the tubular shaft 52 being fastened to an upper seal housing 55. The upper seal housing 55 is fixedly attached and sealingly connected to an upper insulator mounting flange 53. In turn, the upper mounting flange 53 is affixed to the upper portion of the insulator 14. The operating member 42 passes through the apertured mounting flange 53 and the upper seal housing 55. The seal housing 55 includes a bearing 51 through which the operating member 42 passes. In a specific arrangement, the operating member 42 is fabricated from glass-epoxy tubing or rod.

Figure 2:
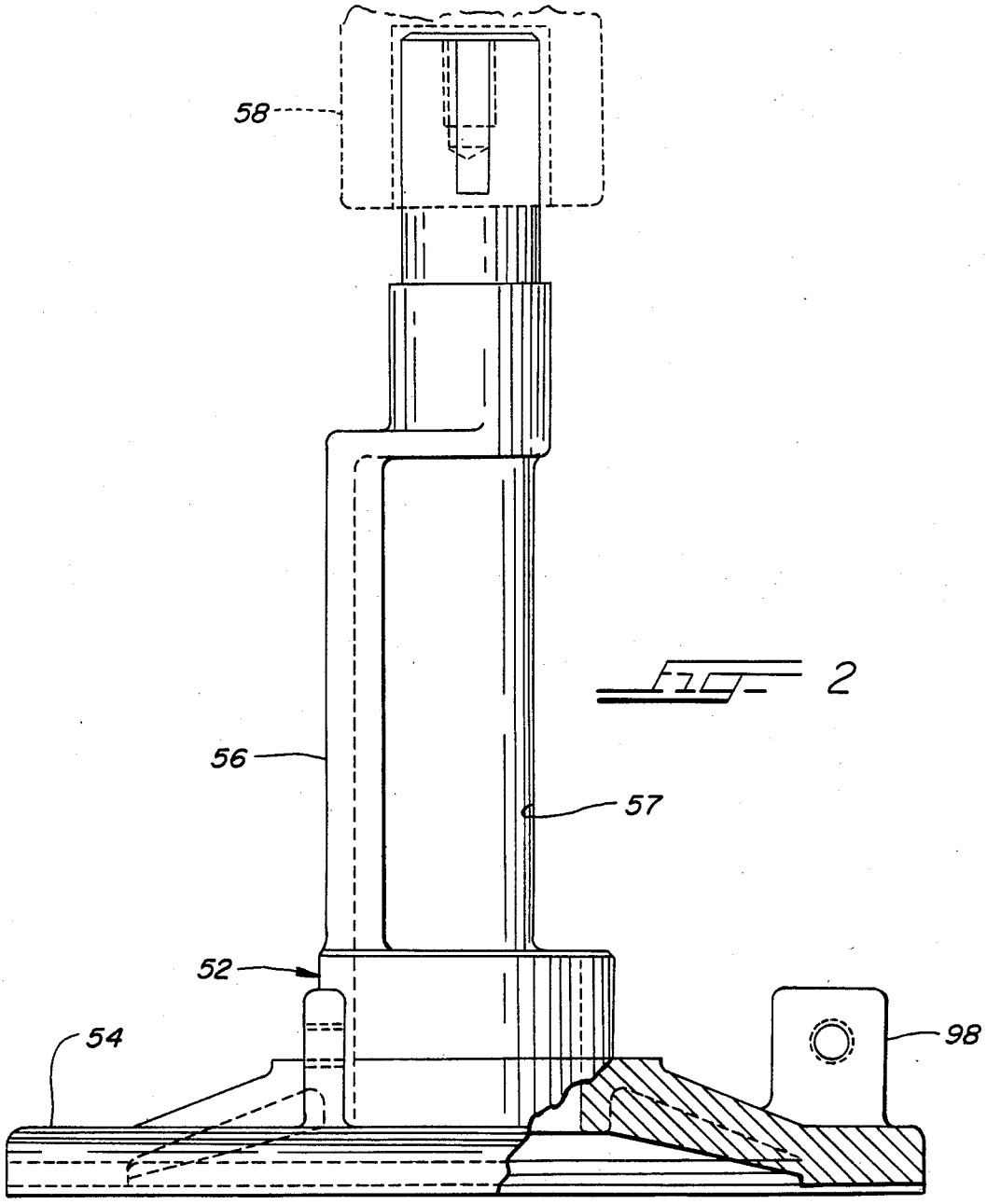
FIG. 2 is an elevational view of the tubular shaft carried at the upper portion of the rotatable support column of FIG. 1.
Figure 3:
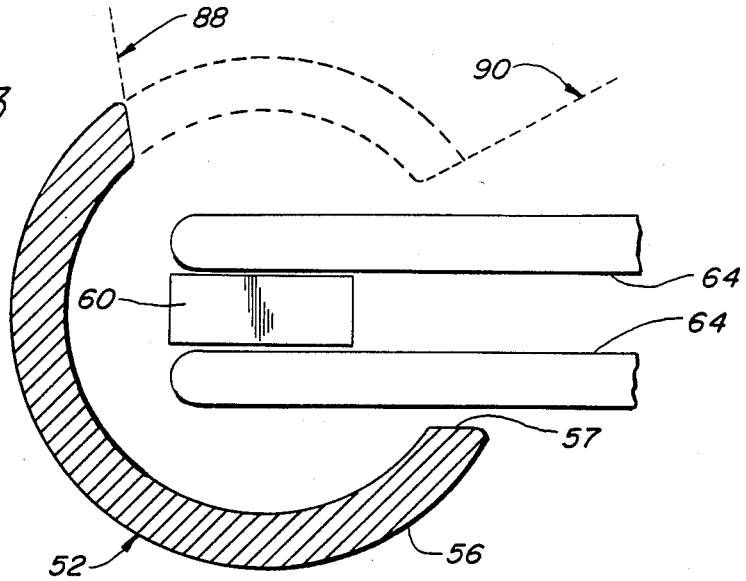
FIG. 3 is a sectional view of the upper spindle taken along the line 3—3 of FIG. 1.
Figure 5:
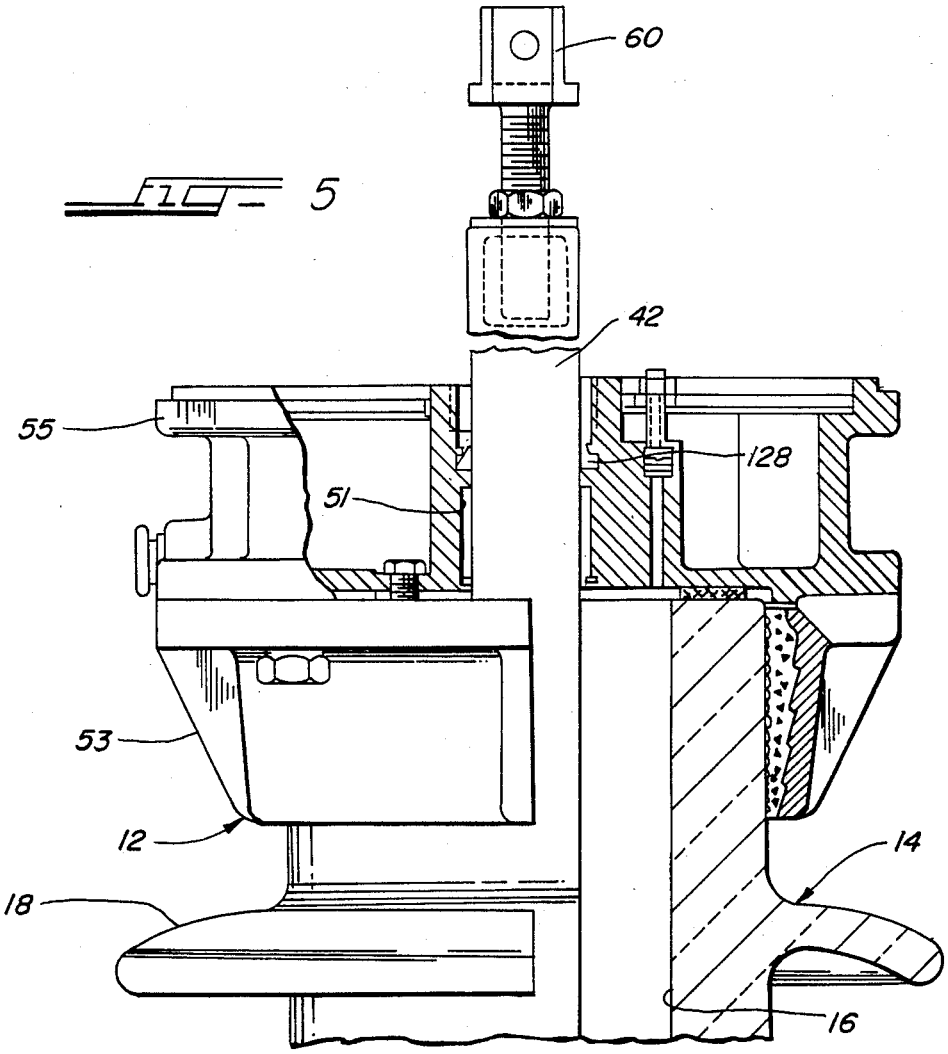
FIG. 5 is an enlarged elevational view, partly in section and with parts cut away, of the upper portion of the rotatable support column of FIG. 1.

Referring now additionally to FIGS. 2 and 3, a central, elongated portion 56 of the tubular shaft 52 fixedly carries a linkage connector 58. The linkage connector 58 is connected to a suitable drive linkage for the specific application; for example, a disconnect drive that operates from a rotary input as shown in U.S. Pat. No. 3,508,178, to which reference may be made for a more detailed discussion. In any event, when the support column 12 is rotated via the rotary drive input at linkage 38, the shaft portion 56 and the linkage connector 58 rotate to drive a disconnect blade or the like.

In accordance with important aspects of the present invention, the portion 56 is cut away at 57, i.e., fabricated with a suitable aperture 57 to provide for the interconnection of an upper end fitting 60 of the operating member 42 to a linear drive linkage 62. In the specific illustration of FIGS. 1–3, the linear drive linkage 62 includes a bell crank 64 pivotally mounted with respect to a housing 68. The housing 68 is rotatably mounted with respect to the tubular shaft 52 via suitable bearings at 70,72. The housing 68 is also fixedly mounted to an interrupter unit or the like referred to generally at 74.

For illustrative purposes, the interrupter unit 74 includes switch contacts 76 which are opened and closed by linear reciprocation of the interrupter operator member 78. The interrupter operator member 78 is pivotally and slidably connected through a drive link 80 to the bell crank 64 of the drive linkage 62. Similarly, the bell crank 64 is pivotally and slidably connected to the upper end fitting 60 of the operating member 42. As the operating member 42 reciprocates within and with respect to the support column 12 in the direction referred to at 50, this linear motion is translated from a vertical direction along the longitudinal axis of the support column 12 as shown in FIG. 1 to a horizontal direction aligned with the longitudinal axis of the interrupter unit 74 to drive the interrupter operator member 78.

The operating member 42 is illustrated in FIG. 1 in an upper position corresponding to the switch-closed position of the interrupter contacts 76. Correspondingly, when the operating member 42 is moved to the lower position (shown in phantom at 86 in FIG. 1) in response to counterclockwise pivoting of the drive linkage 48, the member 64 is pivoted counterclockwise and opens the switch contacts 76 of the interrupter 74.

Considering the rotary drive output at 58, and referring specifically to FIG. 3, the position of the tubular shaft 52 in FIG. 3 corresponds to a counterclockwise rotated position referred to at 88, which in turn corresponds to a disconnect-closed position. Correspondingly, the clockwise rotation position of the tubular shaft (shown in phantom at 90 in FIG. 3) corresponds to the disconnect-open position.

It should be noted that in accordance with the present invention, although the rotary and linear drives share a common support and drive column 14, the operation of each drive arrangement is independent. Accordingly, each drive is separately operable as to sequence and position; i.e., rotation of the support column 12 causes a change in rotary position of the rotary drive output at 58, but does not effect either the rotary or linear position of the operating member 42, the linkage assembly 62, or the interrupter contacts 76. Further, since the interrupter unit 74 is operated solely by movement of the operating member 42 and not the rotatable support column 12, the speed of operation is optimized; i.e. only the mass of the operating member 42 is driven. Since the operating member 42 is disposed within the rotatable support column 12 and is protected from the external environment, the operating member 42, although subjected to line-to-ground voltage, does not require independent insulator skirts to achieve appropriate dielectric properties and leakage distance. Accordingly, the operating member 42 is capable of fabrication with the minimum mass consistent with sufficient tension and compression strength for the operation of the interrupting unit 74.

In accordance with additional aspects of the present invention, an overtravel limit arrangement 96 is provided to prevent rotation of the shaft portion 56 beyond a predetermined desirable limit position. To this end, the tubular shaft 52 is provided with an upstanding member 98 and the housing 68 is provided with a cooperating protruding stop member 100. When the tubular shaft 52 is rotated to the counterclockwise position of FIGS. 1 and 3, the member 98 approaches the limit position adjacent the stop member 100. If the linkage input at 40 is driven into an overtravel condition, the member 98 abuts the stop member 100 and the overtravel is limited to prevent any overtravel input to the connected components at 58 and further to prevent any interference with the linear drive linkage 62. The cooperation of the rotary and linear drive arrangements with the overtravel limit arrangement 96 provides advantageous benefits as to the required clearance and tolerance of the independent but adjacent rotary and linear drive trains. Correspondingly, a similar arrangement of members 98 and 100 is provided to limit overtravel in the open position.

Figures 4, 6:
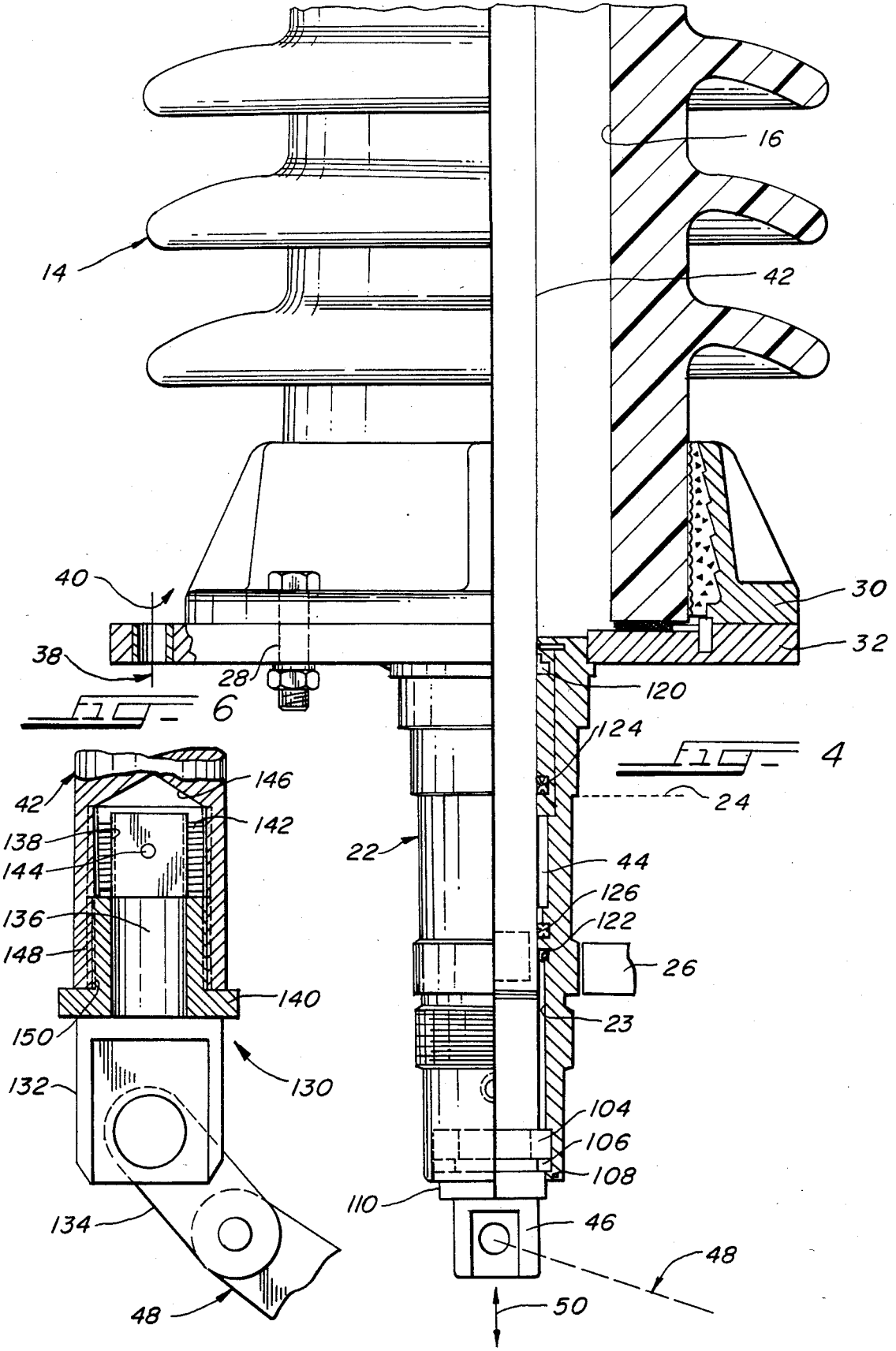
FIG. 4 is an enlarged elevational view, partly in section and with parts cut away, of the lower portion of the rotatable support column of FIG. 1.
FIG. 6 is an elevational view partly in section of an alternate arrangement of the present invention to permit rotation of the operating member.

In accordance with other features and aspects of the present invention, and referring specifically to FIG. 4, a linear overtravel-limiting arrangement is provided to prevent overtravel of the operating member 42 in the upward, closing direction. For this purpose, a shock absorbing, elastomeric ring 104 is carried in the bore 23 of the base member 22. A rigid, contact ring 106 is also carried in the bore 23 of the base member 22. In a specific arrangement, the elastomeric ring 104 and the contact ring 106 are retained by a retaining ring 108 carried in a groove of the base member 22.

The lower end fitting 46 of the operating member 42 includes a widened section 110 having a predetermined diameter D1. For achievement of the overtravel-limiting function, the inner diameter D2 of the contact ring 106 is less than D1 so as to be in contact by the widened section 110 as the drive arrangement 48 is pivoted past the position shown in FIGS. 1 and 4 which is defined as an overtravel condition. The inner diameter D3 of the elastomeric ring 104 is equal to or somewhat less than D2. If the operating member 42 is driven at connector 48 toward an overtravel condition, the section 110 drives the contact ring 106 into the shock absorbing ring 104 to limit the overtravel while providing shock absorbing characteristics to thereby avoid a rigid limit condition which is undesirable for the linear linkage and the operating member 42. Accordingly, the rings 104 and 106 function as a limiting arrangement with shock absorbing characteristics.

For desirable voltage withstand and insulating properties, the bore 16 of the insulator 14 is filled with an insulating material. Various liquids are commonly used in insulators of this type. For preferred operating properties of the rotatable support column 12 with the reciprocating member 42, it is desirable to fill the insulator bore 14 with the insulating material as disclosed and claimed in co-pending, commonly assigned application Ser. No. 721,615 filed in the names of L. V. Chabala et al on Apr. 10, 1985, to which reference may be made for a more complete discussion of this insulating material. While the operation of the present invention and the rotatable support column 12 are enhanced by this referenced insulating material, the insulating material disclosed and claimed in the aforementioned application does not form a part of the present invention. However, certain desirable operating features have been achieved by making use of this insulating material filler and by incorporating certain structural features into the rotatable support column 12. For example, wiper rings 120 and 122 are carried by the base member 22 to reduce any leakage problem due to the rapidly moving operating member 42 moving through the insulating material. The wiper rings 120 and 122 intimately conform to the surface of the operating member 42 to strip the insulating material from the operating member 42. Further, seal rings 124,126 are carried by the base member 22. Similarly, the upper seal housing 55 carries a wiper ring 128 similar to the wiper ring 120. Additionally, the insulating material provides a measure of lateral support to the rapidly-moving operating member 42.

In various other specific embodiments of the drive arrangement of the present invention, the operating member 42 rotates with the support column 12 while still providing an independent linear drive output by reciprocation with respect to the support column 12. For example, as discussed hereinbefore with respect to the arrangement of FIGS. 1–5, the operating member 42 remains fixed in rotational position due to the connection at the linear drive linkage 62 and the bell crank 48, while the rotatable support column 12 rotates about the operating member 42; i.e. the operating member 42 and the support column 12 rotate with respect to each other at bearings 44 and 51. In another arrangement, the connection of the operating member 42 to the bell crank 48 and the linkage 62 is accomplished through swivel mechanisms. In that arrangement, the operating member 42 rotates with the support column 12 and with respect to the bell crank 48 and the drive linkage 62. In another arrangement, wherein the interrupter unit 74 is supported atop the rotatable support column 12 and affixed thereto with alignment of the respective longitudinal axes of the operating member 42 and the interrupter operating member 78, the operating member 42 can be either held fixed by the bell crank 48 or allowed to rotate with the support column 12 by the provision of a swivel connection between the bell crank 48 and the lower end fitting 46 of the operating member 42. Where the operating member 42 is held stationary, the interrupter operator member 78 rotates with respect to the operating member 42 by the provision of a swivel connection at the connection of members 60,78. Of course, if the interrupter unit 74 permits swiveling of the interrupter operating member 78, no additional swivel coupling is required.

Referring now to FIG. 6, one specific swivel mechanism 130 is illustrated in place of the lower end-fitting 46 of the operating member 42 of FIG. 1. The swivel mechanism 130 includes a swivel rod end 132 that connects to the bell crank 48 via a slide link 134 which is also utilized with the arrangment of FIG. 1. The swivel rod end 132 includes an elongated portion 136 which includes a threaded portion 138 at the distant end. The elongated portion 136 of the swivel rod end 132 is inserted through a retaining bushing 140 and a swivel collar nut 142 is threaded onto the threaded portion 138 of the rod end 132. A cross pin 144 is inserted through aligned bores in the swivel rod end 132 and the swivel collar nut 142. The entire assembly is then affixed to the operating rod 42 by threading the assembly into threads 148 provided in a cavity 146 of the operating member 42; threads 150 being provided on the outside of the retaining bushing 140 to engage the threaded cavity portion 148. Accordingly, the operating member 42 is free to rotate with the retaining bushing 140 rotating about the swivel rod end 132 and the elongated portion 136.

While there has been illustrated and described various embodiments of the present invention, it will be apparent that various changes and modifications will occur to those skilled in the art. It is intended in the appended claims to cover all such changes and modifications as fall within the true spirit and scope of the present invention.

What is claimed and desired to be secured by Letter Patent of the United States is:

1. An arrangement for providing independent rotary and linear drive outputs for driving electrical switches, comprising:

an elongated insulator including a longitudinal bore extending therethrough;

a base member affixed to a first end of said insulator, said base member including an elongated bore formed therethrough and means adapted for rotatably mounting said base member, rotation of said insulator providing a rotary drive output; and an elongated operating member of insulating material disposed in and extending through said bore of said base member and said insulator for translational movement with respect to said base member and said insulator, said translational movement being generally aligned with the longitudinal axis of said insulator.

2. The arrangement of claim 1 further comprising means for providing rotation and translation of said operating member relative to said base member.

3. The arrangement of claim 1 or 2 further comprising means carried in the bore of said base member for providing a sealing relationship between said operating member and said base member.

4. The arrangement of claim 1 or 2 further comprising an interrupter unit having one end affixed at the second end of said insulator and having a longitudinal axis aligned with said longitudinal axis of said insulator.

5. The arrangement of claim 4 wherein said interrupting unit includes an interrupter actuator connected to said elongated operating member, translational movement of said operating member operating said interrupter unit between open and closed states.

6. The arrangement of claim 5 further comprising means connected to a first end of said elongated operating member adjacent said base member for translating said operating member.

7. The arrangement of claim 6 further comprising means for rotating said insulator.

8. The arrangement of claim 7 wherein said operating member translating means includes means for allowing said operating member to rotate.

9. The arrangement of claim 8 further comprising a disconnect blade carried by said insulator.

10. The arrangement of claim 1 or 2 further comprising means for rotating said base member and means for translating said operating member.

11. The arrangement of claim 10 wherein said operating member is a predetermined length and extends outside the second end of said insulator and outside said base member.

12. The arrangement of claim 10 further comprising means for sealing said insulator bore at said second end and for allowing passage of said operating member therethrough.

13. The arrangement of claim 12 wherein said operating member is of a predetermined length such that both ends are external to said base member and said insulator throughout translational movement between two positions of a reciprocative path.

14. The arrangement of claim 10 further comprising a generally hollow upper member fixedly carried at said second end of said insulator.

15. The arrangement of claim 14 wherein said upper member includes an aperture in the side wall thereof.

16. The arrangement of claim 15 further comprising directional translation linkage means connected to said operating member and passing through said aperture of said upper member for translating movement of said operating member to translational movement in a different predetermined direction.

17. The arrangement of claim 16 wherein said upper member includes a widened base portion affixed to said second end of said insulator.

18. The arrangement of claim 16 wherein said aperture is dimensioned to provide for a predetermined amount of rotation of said upper member without interference with said translational movement of said operating member and said directional translation linkage means.

19. The arrangement of claim 18 wherein said directional translation linkage means comprises a pivoting member having one end pivotally connected to said operating member.

20. The arrangement of claim 16 further comprising an interrupter actuating member, said directional translation linkage means being connected to drive said interrupter actuating member.

21. The arrangement of claim 20 wherein said rotation of said upper member represents a rotary drive output, said arrangement further comprising rotary drive linkage means connected to said rotary drive output for providing operation of a disconnect switch mechanism.

22. The arrangement of claim 16 further comprising a transition housing rotatably supported by said upper member, said upper member passing through said transition housing, said transition housing enclosing said directional translation linkage means, said directional translation linkage means comprising a bell crank pivotally mounted with respect to said transition housing, said bell crank being pivotally connected to said operating member and said interrupter actuating means.

23. The arrangement of claim 22 further comprising rotational limiting means for limiting the rotation of said upper member to a predetermined maximum rotation, said rotational limiting means comprising means extending from said transition housing for cooperation with means extending from said base portion of said upper member.

24. The arrangement of claim 1 further comprising means for limiting the extent of translational movement of said operating member in a direction from said first end toward the second end of said insulator, said translational movement limiting means comprising means carried by said operating member arranged to interfere with means carried by said base member.

25. An arrangement for providing a rotary output drive and a translational output drive for operating electrical switches, comprising:

a rotatably mounted generally hollow member; and an operating member disposed for translational movement along a path within said hollow member, said hollow member including a lateral aperture of predetermined dimensions to allow external connection at a predetermined point along said operating member so that for a predetermined degree of rotational movement of said hollow member said operating member is movable along said path independent of the rotary position of said hollow member and without interference therebetween.

26. The arrangement of claim 25 further comprising a rotatably mounted insulator affixed to said hollow member and means for rotating said insulator.

27. The arrangement of claim 26 wherein said insulator includes an elongated bore through which said operating member is disposed.

28. The arrangement of claim 25 or 27 further comprising directional translation linkage means connected to said operating member and passing through said aperture of said hollow member for translating movement of said operating member to translational movement in a different predetermined direction.

29. The arrangement of claim 25 or 27 wherein said hollow member is generally cylindrical.

30. The arrangement of claim 26 or 27 wherein said hollow member includes a tubular shaft portion and a base flange section which is affixed to said insulator, said lateral aperture being in the side wall of said tubular shaft, said operating member disposed in said tubular shaft.

* * * * *